US009419361B2

(12) United States Patent
Daily et al.

(10) Patent No.: US 9,419,361 B2
(45) Date of Patent: Aug. 16, 2016

(54) ELECTRICAL CONNECTOR WITH PIVOT BLOCK FOR TERMINATING AN ELECTRICAL WIRE

(71) Applicant: Tyco Electronics Corporation, Berwyn, PA (US)

(72) Inventors: Christopher George Daily, Harrisburg, PA (US); Edward John Howard, Millersburg, PA (US); Matthew Edward Mostoller, Hummlestown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 22 days.

(21) Appl. No.: 14/493,842

(22) Filed: Sep. 23, 2014

(65) Prior Publication Data

US 2016/0087363 A1 Mar. 24, 2016

(51) Int. Cl.

| | |
|---|---|
| ***H01R 13/193*** | (2006.01) |
| ***H01R 4/48*** | (2006.01) |
| ***H01R 9/24*** | (2006.01) |
| *H01R 12/51* | (2011.01) |
| *H01R 13/11* | (2006.01) |

(52) U.S. Cl.

CPC ..... *H01R 13/193* (2013.01); *H01R 4/48* (2013.01); *H01R 9/2416* (2013.01); *H01R 12/515* (2013.01); *H01R 13/111* (2013.01)

(58) Field of Classification Search

USPC ..... 439/409, 262, 264, 265, 325, 725

See application file for complete search history.

(56) References Cited

U.S. PATENT DOCUMENTS

| | | | | | |
|---|---|---|---|---|---|
| 3,944,315 | A | * | 3/1976 | Hild et al. | 439/431 |
| 4,494,813 | A | | 1/1985 | Daley, Jr. et al. | |
| 4,627,675 | A | * | 12/1986 | Taylor et al. | 439/92 |
| 5,190,470 | A | * | 3/1993 | Soes et al. | 439/417 |
| 5,429,530 | A | * | 7/1995 | Zander et al. | 439/620.26 |
| 5,667,402 | A | * | 9/1997 | Denovich et al. | 439/409 |
| 5,729,442 | A | | 3/1998 | Frantz | |
| 5,742,464 | A | * | 4/1998 | Ceola et al. | 361/103 |

(Continued)

FOREIGN PATENT DOCUMENTS

| | | |
|---|---|---|
| DE | 3644349 C1 | 2/1988 |
| DE | 10 2010 009169 A1 | 8/2011 |

(Continued)

OTHER PUBLICATIONS

International Search Report, Application No. PCT/2015/051381, International Filing Date, Sep. 22, 2015.

*Primary Examiner* — Alexander Gilman

(57) ABSTRACT

An electrical connector includes a housing and an electrical contact held by the housing. The electrical contact includes opposing spring beams configured to receive an electrical wire therebetween. The spring beams have conductor interfaces configured to engage in physical contact with the electrical wire such that the electrical wire is captured between the spring beams with a compliant pinch connection. A pivot block is held by the housing, includes a receptacle for receiving the electrical wire, and is pivotable between an open position and a closed position. The pivot block is configured to be pivoted from the open position to the closed position to move the electrical wire into engagement in physical contact between the conductor interfaces of the spring beams such that the electrical wire is captured between the spring beams with the compliant pinch connection and thereby electrically connected to the electrical contact.

17 Claims, 6 Drawing Sheets

(56) References Cited

U.S. PATENT DOCUMENTS

| | | | | |
|---|---|---|---|---|
| 5,766,045 | A | 6/1998 | Sawaki et al. | |
| 5,947,761 | A * | 9/1999 | Pepe | 439/409 |
| 6,152,760 | A * | 11/2000 | Reeser | 439/409 |
| 6,254,421 | B1 * | 7/2001 | Denovich et al. | 439/409 |
| 6,336,824 | B1 * | 1/2002 | Sorig | 439/441 |
| 6,692,284 | B1 * | 2/2004 | Koh | 439/346 |
| 6,773,294 | B1 * | 8/2004 | Urban et al. | 439/409 |
| 7,399,197 | B2 * | 7/2008 | Fasce et al. | 439/392 |
| 7,523,898 | B1 * | 4/2009 | Barry et al. | 248/71 |
| 7,569,777 | B1 * | 8/2009 | Gillam | 174/562 |
| 7,628,640 | B2 * | 12/2009 | Radle | 439/441 |
| 7,722,389 | B2 * | 5/2010 | Benoit et al. | 439/535 |
| 7,867,646 | B2 * | 1/2011 | Rhodes | 429/100 |
| 8,274,019 | B2 * | 9/2012 | Morin et al. | 219/482 |
| 8,672,703 | B2 * | 3/2014 | Fehling et al. | 439/417 |

FOREIGN PATENT DOCUMENTS

| | | | |
|---|---|---|---|
| JP | H08 153549 | A | 6/1996 |
| JP | 2007 280639 | A | 10/2007 |

* cited by examiner

ELECTRICAL CONNECTOR WITH PIVOT BLOCK FOR TERMINATING AN ELECTRICAL WIRE

BACKGROUND OF THE INVENTION

The subject matter described herein relates generally to an electrical connector having a pivot blocks for terminating electrical wires.

Some electrical connectors that terminate electrical wires include pivot blocks that pivot between open and closed positions. In the open position, the pivot blocks are oriented to receive the ends of corresponding electrical wires, which may been stripped to expose the conductors thereof. The pivot blocks are pivoted from the open positions to the closed positions to engage the electrical conductors of the electrical wires in electrical connection with corresponding electrical contacts of the electrical connector.

Pivot block style connectors are not without their disadvantages. For example, the electrical contacts of at least some known pivot block style connectors are insulation displacement design (IDC) type contacts. But, IDC contacts may be limited to terminating only a few (e.g., one to two) sizes of electrical wires. IDC contacts may be limited to electrical wires having solid conductors or conductors having no more than seven strands. Moreover, the force required to terminate an electrical wire to an IDC contact may be relatively high, which may require special tooling and/or may increase operator fatigue.

SUMMARY OF THE INVENTION

In an embodiment, an electrical connector includes a housing and an electrical contact held by the housing. The electrical contact includes opposing spring beams configured to receive an electrical wire therebetween. The spring beams have conductor interfaces configured to engage in physical contact with the electrical wire such that the electrical wire is captured between the spring beams with a compliant pinch connection. A pivot block is held by the housing and includes a receptacle. The pivot block is pivotable between an open position and a closed position. The receptacle is configured to receive the electrical wire when the pivot block is in the open position. The pivot block is configured to be pivoted from the open position to the closed position to move the electrical wire into engagement in physical contact between the conductor interfaces of the spring beams such that the electrical wire is captured between the spring beams with the compliant pinch connection and thereby electrically connected to the electrical contact.

In an embodiment, an electrical connector includes a housing and an electrical contact held by the housing. The electrical contact includes opposing spring beams configured to receive an electrical wire therebetween. The spring beams have conductor interfaces configured to engage in physical contact with the electrical wire to electrically connect the electrical contact to the electrical wire. The spring beams are resiliently deflectable from natural resting positions thereof such that the spring beams pinch the electrical wire between the conductor interfaces. A pivot block is held by the housing. The pivot block includes a receptacle. The pivot block is pivotable between an open position and a closed position. The receptacle is configured to receive the electrical wire when the pivot block is in the open position. The pivot block is configured to be pivoted from the open position to the closed position to pinch the electrical wire between the conductor interfaces of the spring beams of the electrical contact.

In an embodiment, a thermostat assembly includes a thermostat having a printed circuit that includes mating contacts. An electrical connector is mated with the thermostat and includes a housing and electrical contacts held by the housing such that the electrical contacts are configured to be electrically connected to corresponding mating contacts of the printed circuit. The electrical contacts include opposing spring beams configured to receive an electrical wire therebetween. The spring beams have conductor interfaces configured to engage in physical contact with the electrical wire to electrically connect the electrical contact to the electrical wire. The spring beams are resiliently deflectable from natural resting positions thereof such that the spring beams pinch the electrical wire between the conductor interfaces. Pivot blocks are held by the housing. The pivot blocks include receptacles and are pivotable between open positions and closed positions. The receptacles are configured to receive corresponding electrical wires when the pivot blocks are in the open positions. The pivot blocks are configured to be pivoted from the open positions to the closed positions to pinch the electrical wires between the conductor interfaces of the spring beams of the corresponding electrical contacts.

DETAILED DESCRIPTION OF THE DRAWINGS

Figure 1:
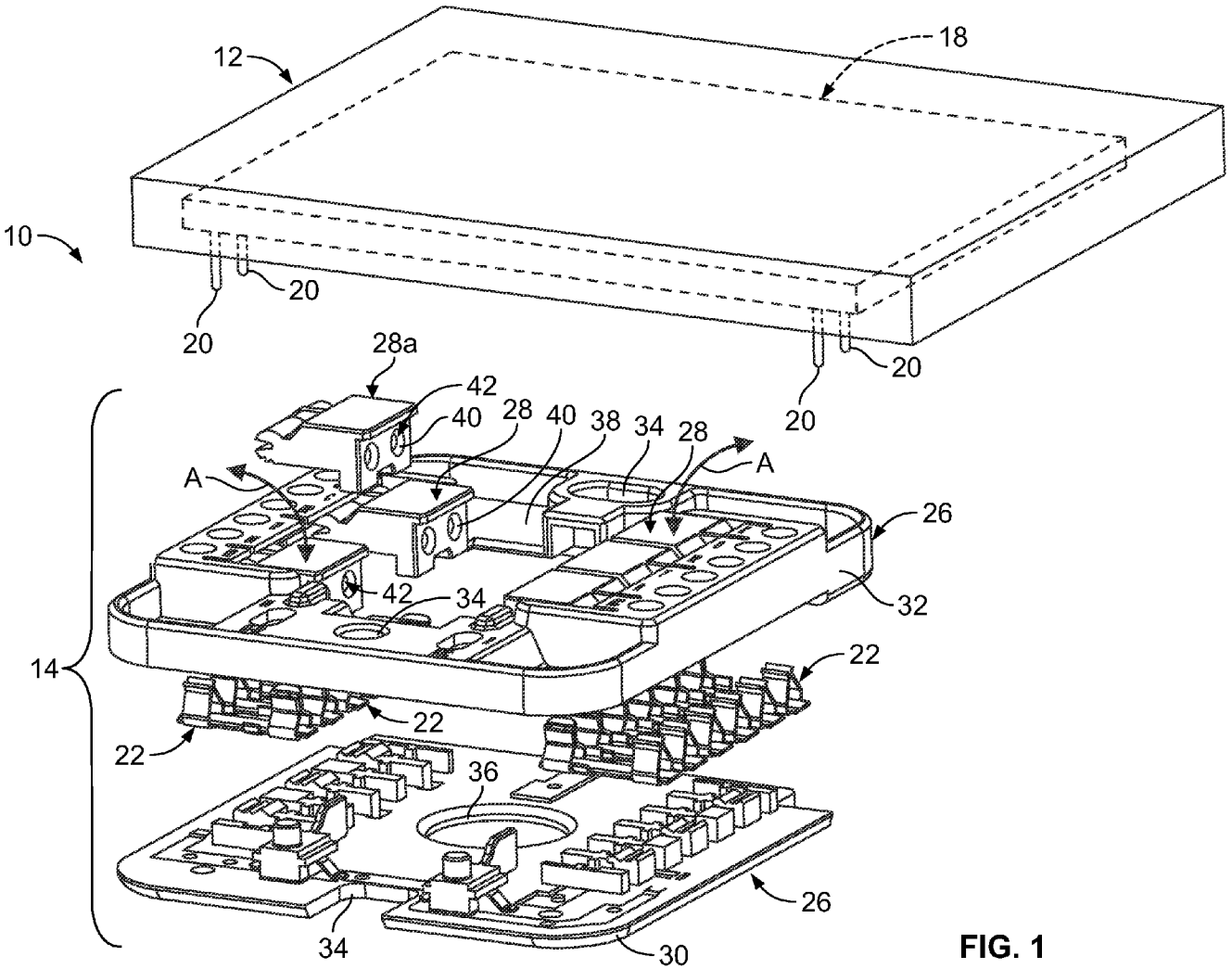
FIG. 1 is an exploded perspective view of an embodiment of a thermostat assembly.

FIG. 1 is an exploded perspective view of an embodiment of a thermostat assembly 10. The thermostat assembly 10 includes a thermostat 12 and an electrical connector 14. The thermostat 12 is mounted to the electrical connector 14. In the illustrated embodiment, the electrical connector 14 is configured to be mounted to a wall (not shown) and mated with the thermostat 12 such that the electrical connector 14 is electrically connected with the thermostat 12 and the thermostat 12 is mounted to the wall. But, the electrical connector 14 may be mated with the thermostat 12 in any other configuration, arrangement, and/or the like. For example, in some embodiments the thermostat 12 and/or the electrical connector 14 are not mounted to a wall, but rather are mounted to another surface, such as, but not limited to, a floor, a ceiling, a piece of furniture, a fixture, another structure, and/or the like.

The thermostat 12 includes a printed circuit 18 having mating contacts 20. As will be described below, electrical contacts 22 of the electrical connector 14 are configured to be mated with the mating contacts 20 of the thermostat 12 to establish an electrical connection between the electrical connector 14 and the thermostat 12.

Figure 2:
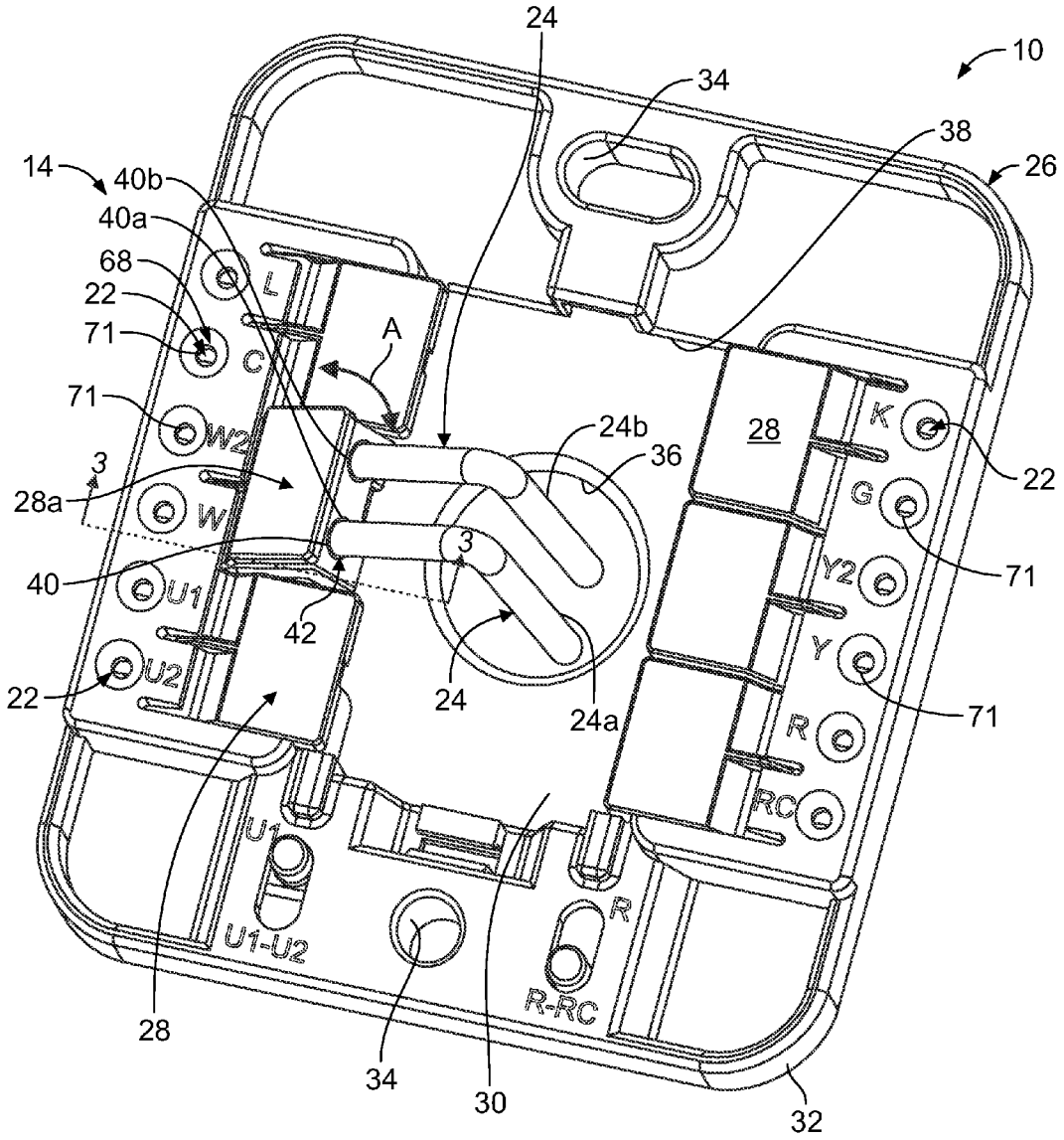
FIG. 2 is a perspective view of an embodiment of an electrical connector of the thermostat assembly shown in FIG. 1.

FIG. 2 is a perspective view of an embodiment of the electrical connector 14. Referring now to FIGS. 1 and 2, the electrical connector 14 is pivot block style connector that terminates one or more electrical wires 24 (not shown in FIG. 1). Although the electrical connector 14 is shown as defining a portion of the thermostat assembly 10, the electrical connector 14 is not limited to being used as a portion of a thermostat assembly. Rather, the electrical connector 14 additionally or alternatively may mate with any other device besides a thermostat and may be used to terminate electrical wires for any other electrical device besides a thermostat assembly. The thermostat assembly 10 and the thermostat 12 (not shown in FIG. 2) are meant as only one exemplary application of the electrical connector 14.

As shown in FIG. 2, the electrical connector 14 is configured to terminate the electrical wires 24. Optionally, the electrical wires 24 are grouped together in a cable (not shown). In the illustrated embodiment, the electrical connector 14 provides an electrical path between the electrical wires 24 and the printed circuit 18 (not shown in FIG. 2) of the thermostat 12. In other embodiments, the electrical connector 14 is configured to mate with another electrical device besides a thermostat for providing an electrical path between the electrical wires 24 and the other electrical device. In still other embodiments, the electrical connector 14 terminates one or more other electrical wires (not shown) for providing an electrical path between the electrical wires 24 and the other electrical wires. The other electrical wires may or may not be grouped together in a cable (not shown).

The electrical connector 14 includes a housing 26, the electrical contacts 22, and pivot blocks 28. The electrical contacts 22 and the pivot blocks 28 are held by the housing 26. In the illustrated embodiment, the housing 26 includes a base plate 30 and a cover plate 32, with the base plate 30 holding the electrical contacts 22 and the cover plate 32 holding the pivot blocks 28. The base plate 30 and the cover plate 32 also define a wall plate assembly in the illustrated embodiment for mounting the electrical connector 14 to a wall. As best seen in FIG. 1, the plates 30 and/or 32 may include openings 34 and/or other features that facilitate mounting the electrical connector 14 on the wall and/or other surface. As shown in both FIGS. 1 and 2, the plates 30 and 32 include respective openings 36 and 38 for receiving the electrical wires 24. The housing 26 additionally or alternatively may have other configurations, arrangements, structures, geometries, and/or the like, which may depend on the particular application of the electrical connector 14.

The pivot blocks 28 are held by the cover plate 32 of the housing 26 such that the pivot blocks 28 are pivotable between open and closed positions. Specifically, the pivot blocks 28 are pivotable along an arc A between the open and closed positions. The pivot blocks 28 are shown in the closed positions in FIGS. 1 and 2, with the exception of a pivot block 28*a* that is shown exploded in FIG. 1 and in the open position in FIG. 2. Each pivot block 28 includes one or more receptacles 40. When a pivot block 28 is in the open position, each receptacle 40 thereof is configured to receive one or more corresponding electrical wires 24 therein. Specifically, the receptacles 40 include entrances 42 through which the electrical wires 24 are inserted. Two electrical wires 24*a* and 24*b* are shown in FIG. 2 received within corresponding receptacles 40*a* and 40*b* of the corresponding pivot block 28*a*. Although two are shown, each pivot block 28 may include any number of receptacles 40 and each pivot block 28 may receive any number of electrical wires 24. Moreover, the electrical connector 14 may include any number of pivot blocks 28 and may terminate any number of electrical wires 24. An equal number of the electrical contacts 22 may be required for each corresponding entrance 42.

Figure 3:
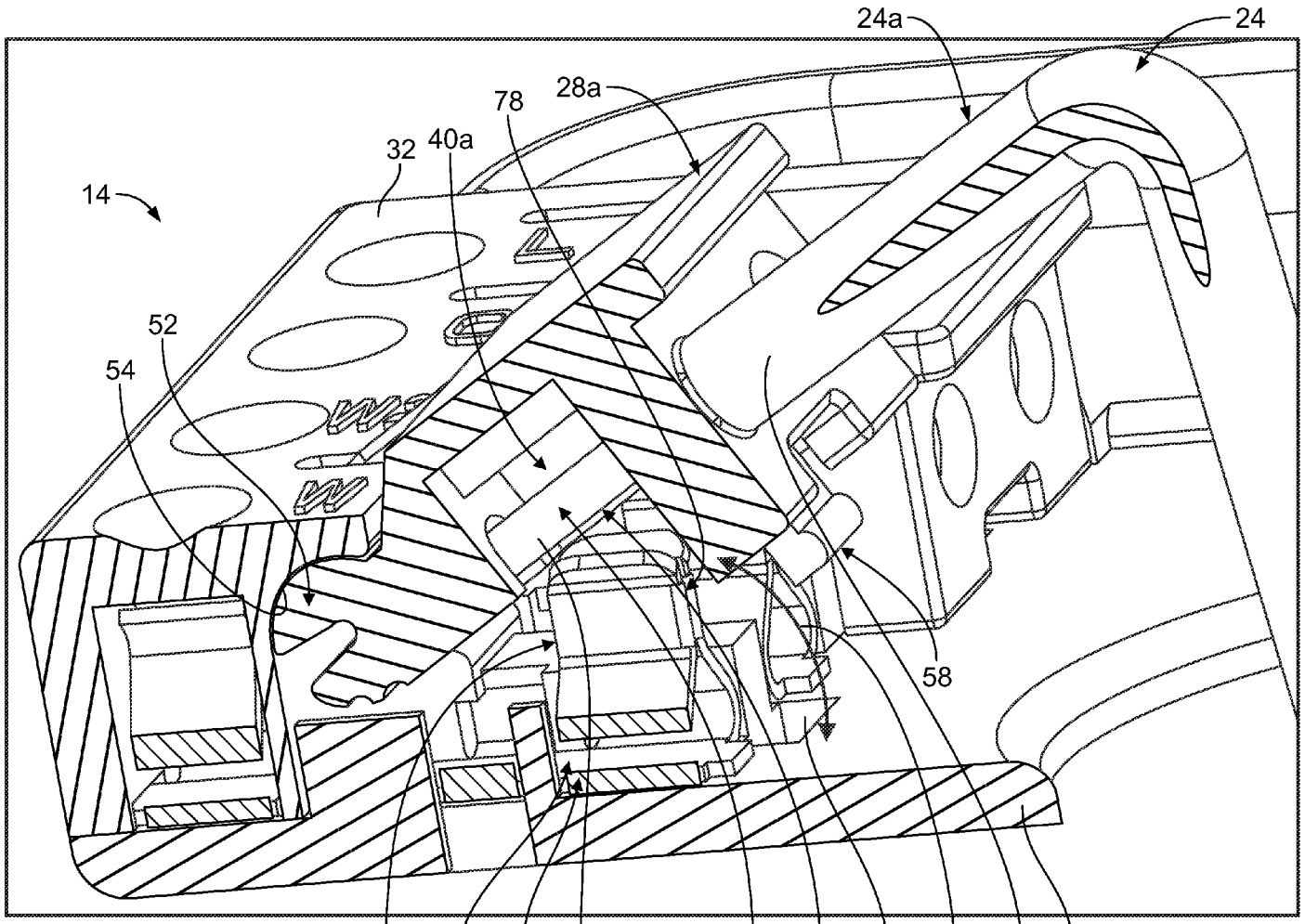
FIG. 3 is a perspective view of a portion the electrical connector shown in FIG. 2 illustrating a cross-section of the electrical connector taken along line 3-3 of FIG. 2.

FIG. 3 is a perspective view of a portion of the electrical connector 14 illustrating a cross-section (taken along line 3-3 of FIG. 2) of the electrical connector 14. FIG. 3 illustrates the electrical wire 24*a* received within the receptacle 40*a* of the pivot block 28*a*. In the illustrated embodiment, the electrical wire 24*a* includes an electrical conductor 44 and an insulation layer 46 surrounding the electrical conductor 44. The insulation layer 46 has been stripped away at an end 48 of the electrical wire 24*a* to expose the electrical conductor 44 along the end 48. As shown in FIG. 3, the electrical wire 24*a* is received within the receptacle 40*a* of the pivot block 28*a* such that a segment 50 of the electrical conductor 44 is exposed for engagement in electrical connection with a corresponding electrical contact 22*a*. As will be described below, the pivot block 28*a* can be pivoted from the open position shown in FIG. 3 to the closed position shown in FIGS. 5 and 6 to move the segment 50 of the electrical conductor 44 of the electrical wire 24*a* into engagement in physical contact (and thereby electrical connection) with the corresponding electrical contact 22*a*.

Any structure, mechanism, configuration, arrangement, and/or the like may be used to enable the pivot blocks 28 to be pivotable between the open and closed positions thereof. In the illustrated embodiment, the pivot blocks 28 include bases 52 that are rotatably held by the cover plate 32, as shown in FIG. 3. Specifically, the bases 52 are held within a cradle 54 of the cover plate 32 such that the bases 52 are configured to rotate and thereby pivot the pivot block 28 along the arc A between the open and closed positions. Other structures, mechanisms, configurations, arrangements, and/or the like additionally or alternatively may be used to enable the pivot blocks 28 to be pivot between the open and closed positions.

The pivot blocks 58 optionally include latch tabs 58 for holding the pivot blocks 28 in the closed positions. In the illustrated embodiment, the latch tabs 58 cooperate with corresponding latch openings 60 of the base plate 30 with a snap-fit connection to hold the pivot blocks 28 in the closed positions. But, any other structure, mechanism, connection type (e.g., an interference fit connection), and/or the like may be used to hold the pivot blocks 28 in the closed positions. Moreover, in other embodiments one or more of the pivot blocks 28 additionally or alternatively may cooperate with the cover plate 32 to hold the pivot block(s) 28 in the closed position. Each pivot block 28 may include any number of the latch tabs 58.

The housing 26 may hold any number of the electrical contacts 22. Each electrical contact 22 may engage in physical contact with, and thereby be electrically connect to, any number of electrical wires 24. In the illustrated embodiment, each electrical contact 22 engages in physical contact with a single corresponding electrical wire 24.

Figure 4:
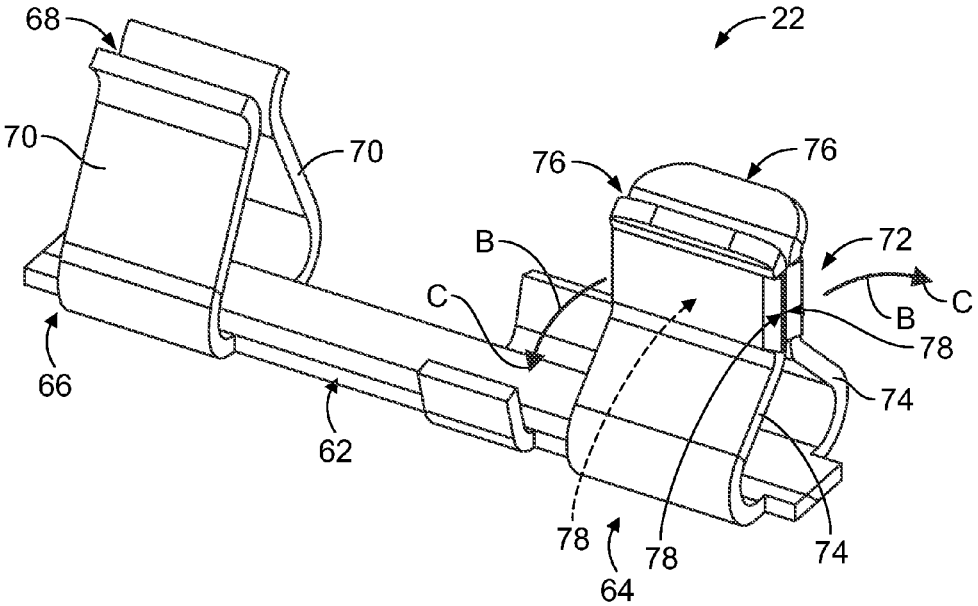
FIG. 4 is a perspective view of an embodiment of an electrical contact of the electrical connector shown in FIGS. 2 and 3.

FIG. 4 is a perspective view of an embodiment of one of the electrical contacts 22 of the electrical connector 14 (FIGS. 1-3, 5, and 6). The electrical contact 22 includes a base 62 that extends from a wire end 64 to a pin end 66. The pin end 66 includes a contact interface 68 at which the electrical contact 22 is configured to mate with the corresponding mating contact 20 (FIG. 1) of the thermostat 12 (FIG. 1). In the illustrated embodiment, the contact interface 68 includes opposing spring beams 70 that pinch the corresponding mating contact therebetween to engage in physical contact with the mating contact 20 and thereby establish an electrical connection between the contacts 20 and 22. Moreover, the illustrated embodiment of the mating contact 20 is a pin such that the illustrated embodiment of the contact interface 68 is configured to mate with the mating contact 20 by engaging in physical contact with the pin. But, the contact interface 68 additionally or alternatively may include any other structure, type of contact interface, and/or the like for mating with any type of mating contact, such as, but not limited to, a surface-mount structure, a press-fit tail (i.e., compliant pin), a solder tail, a structure that is configured to terminate an electrical wire, and/or the like.

Although shown as being located at the pin end 66, additionally or alternatively the contact interface 68 may be located at any other location along the base 62.

Referring again to FIG. 2, the illustrated embodiment of the cover plate 32 of the housing 26 includes one or more openings 71 for receiving the mating contacts 20 therein to enable the mating contacts 20 to mate with the contact interfaces 68 of the corresponding electrical contacts 22.

Referring again to FIG. 4, at the wire end 64 of the base 62, the illustrated embodiment of the electrical contact 22 includes a wire interface 72 at which the electrical contact 22 is configured to terminate the corresponding electrical wire 24 (FIGS. 1-3, 5, and 6). The wire interface 72 includes opposing spring beams 74 that are configured to pinch the electrical conductor 44 (FIGS. 3 and 6) of the corresponding electrical wire 24 therebetween. In other words, and as will be described below, the spring beams 74 are configured to capture the electrical conductor 44 of the corresponding electrical wire 24 therebetween with a compliant pinch connection. In the illustrated embodiment, the wire interface 72, and specifically the spring beams 74, extend along the wire end 64 of the base 62 for receiving the corresponding electrical wire 24 therebetween. But, the wire interface 72 additionally or alternatively may be located at any other location along the base 62.

The spring beams 74 extend from the base 62 to ends 76 thereof. Each spring beam 74 includes a conductor interface 78 at which the spring beam 74 is configured to engage in physical contact with the electrical conductor 44 of the corresponding electrical wire 24 to electrically connect the electrical contact 22 to the corresponding electrical wire 24. As shown in FIG. 4, the conductor interfaces 78 oppose (i.e., face) each other. The spring beams 74 are resiliently deflectable (i.e., compliant) springs that are shown in the natural resting positions thereof in FIG. 4. Specifically, the end 76 of each spring beam 74 is resiliently deflectable from the natural resting position along an arc B in a direction C.

When the electrical conductor 44 of the corresponding electrical wire 24 is received between the conductor interfaces 78 of the spring beams 74, the bias of the spring beams 74 to the natural resting positions shown in FIG. 4 pinches the electrical conductor 44 between the opposing conductor interfaces 78 of the spring beams 74. In other words, the spring beams 74 pinch the electrical conductor 44 of the corresponding electrical wire 24 between the conductor interfaces 78. The engagement in physical contact of the conductor interfaces 78 with the electrical conductor 44 electrically connects the electrical conductor 44 to the spring beams 74, and thus to the electrical contact 22.

The electrical conductor 44 of the corresponding electrical wire 24 is captured between the opposing conductor interfaces 78 of the spring beams 74 with a compliant pinch connection. The electrical conductor 44 may or may not be compressed by the spring beams 74 when the electrical conductor 44 is pinched between the conductor interfaces 78 of the spring beams 74. Moreover, the electrical conductor 44 may or may not be punctured by one or both of the conductor interfaces 78 when the electrical conductor 44 is pinched between the conductor interfaces 78 of the spring beams 74.

The compliant pinch connection between the spring beams 78 and the electrical conductor 44 of the corresponding electrical wire 24 is optionally a separable connection. A "separable connection" is a connection wherein the corresponding electrical wire 24 can be terminated by the electrical contact 22 without damaging the electrical contact 22 and/or without damaging the electrical wire 24. For example, a "separable connection" may be a connection wherein: (1) the corresponding electrical wire 24 can be installed to the electrical contact 22 (i.e., captured between the spring beams 74 with the compliant pinch connection) and later uninstalled from the electrical contact 22 (i.e., removed from between the spring beams 74) without damaging the electrical contact 22 such that another electrical wire 24 can be installed to the electrical contact 22; and/or (2) the corresponding electrical wire 24 can be installed to the electrical contact 22 and later uninstalled from the electrical contact 22 without damaging the electrical contact 22 and without damaging the electrical wire 24 such that the same electrical wire 24 can be re-installed to the electrical contact 22.

Optionally, one or both of the conductor interfaces 78 of the spring beams 74 is an approximately flat (i.e., planar) surface. In the illustrated embodiment, each of the conductor interfaces 78 is an approximately flat surface. The compliant pinch connection and/or providing the conductor interface(s) 78 as an approximately flat surface may enable the electrical contact 22 to accommodate a larger range of sizes of electrical wires. For example, the electrical contact 22 may be capable of accommodating at least four different sizes of electrical wires, such as, but not limited to, between 18-24 AWG. The compliant pinch connection and/or providing the conductor interface(s) 78 as an approximately flat surface may enable the electrical contact 22 to accommodate electrical wires having electrical conductors that include more than seven strands (in addition to accommodating electrical wires having solid electrical conductors and electrical wires having electrical conductors with seven or less strands).

Figure 6:
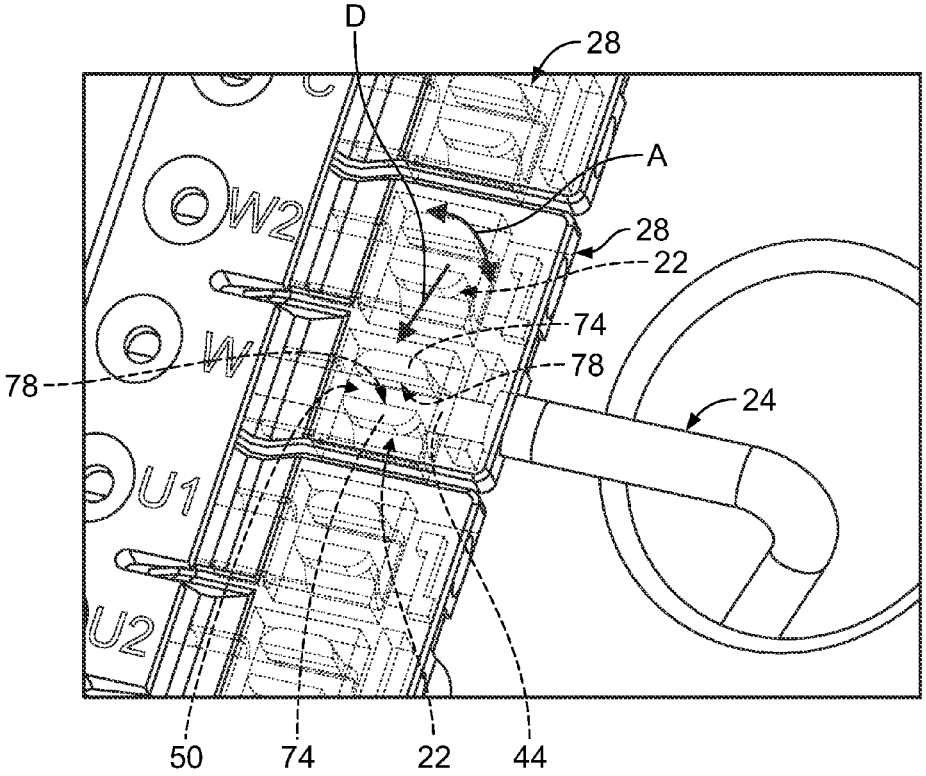
FIG. 6 is an enlarged view of FIG. 5.
Figure 5:
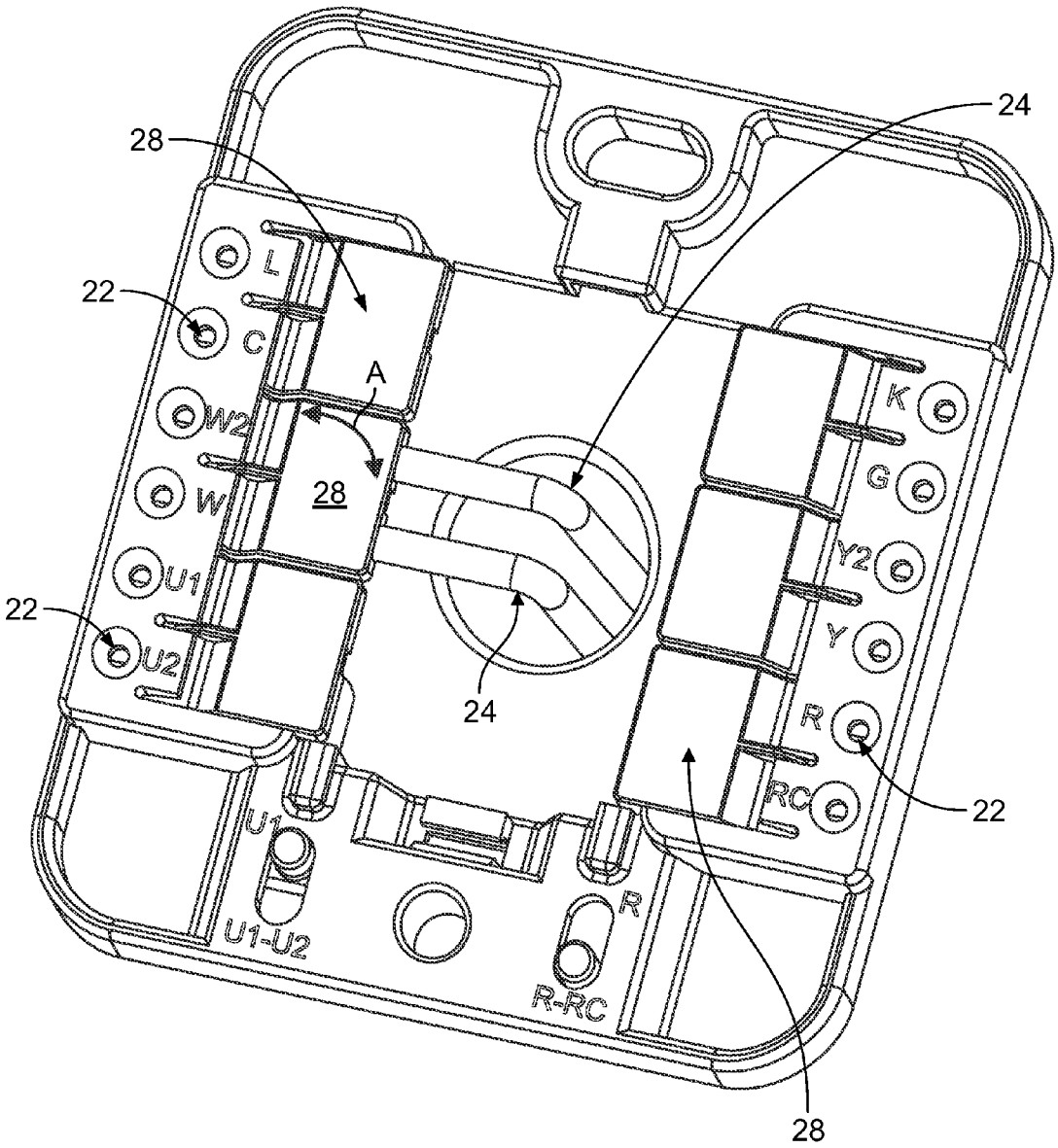
FIG. 5 is another perspective view of the electrical connector shown in FIGS. 2 and 3 illustrating an exemplary electrical wire terminated by the electrical connector.

In operation, the pivot blocks 28 are pivoted from the open positions shown in FIGS. 2 and 3 to the closed position shown in FIGS. 5 and 6 to connect the electrical conductors 44 (not visible in FIGS. 2 and 5) of the electrical wires 24 to the corresponding electrical contacts 22 with the compliant pinch connection and thereby terminate the electrical wires 24 to the corresponding electrical contacts 22. Specifically, the pivot blocks 28 are pivoted along the arc A from the open positions toward the closed positions. Movement of a pivot block 28 along the arc A to the closed position moves the segment 50 (not visible in FIGS. 2 and 5) of the electrical conductor 44 of the corresponding electrical wire 24 into a position between the conductor interfaces 78 (not visible in FIGS. 2 and 5) of the spring beams 74 (not visible in FIGS. 2 and 5) of the corresponding electrical contact 22. Movement of the pivot block 28 to the closed position thereby moves the segment 50 of the electrical conductor 44 of the electrical wire 24 into engagement in physical contact with the corresponding electrical contact 22.

Referring now solely to FIG. 6, as the segment 50 moves into the position between the conductor interfaces 78, the spring beams 74 are deflected away from each other such that the resilience (i.e., bias toward the natural resting position) of the spring beams 74 pinch the segment 50 of the electrical conductor 44 between the opposing conductor interfaces 78. The electrical conductor 44 of the electrical wire 24 is thus captured between the opposing conductor interfaces 78 of the spring beams 74 with a compliant pinch connection, wherein the engagement in physical contact of the conductor interfaces 78 with the electrical conductor 44 electrically connecting the electrical wire 24 to the electrical contact 22.

As discussed above, the electrical conductor 44 is optionally compressed by the spring beams 74 when the electrical conductor 44 is pinched between the conductor interfaces 78 of the spring beams 74. The compliant pinch connection between the spring beams 78 and the electrical conductor 44 of the electrical wire 24 may or may not be a separable connection.

Terminating an electrical wire with the compliant pinch connection of the electrical contacts 22 may require less force to achieve as compared to at least some other known connection types, for example as compared to terminating an electrical wire using an insulation displacement design (IDC) contact. In other words, it may require less force to pivot the pivot blocks 28 to the closed position and thereby terminate electrical wires as compared to the pivot blocks of at least some known pivot block style connectors, for example as compared to pivot block style connectors that use IDC contacts.

Optionally, one or more of the pivot blocks 28 exert a normal force on the electrical conductor 44 of the corresponding electrical wire(s) 24 when the pivot block 28 is in the closed position. The normal force acts in a direction D that is approximately perpendicular to the length of the corresponding electrical wire(s) 24, as is shown in FIG. 6. The normal force may be provided by any structure, mechanism, arrangement, configuration, and/or the like, such as, but not limited to, configuring the latch tab 58 (FIG. 3) with respect to the latch opening 60 (FIG. 3) such that the pivot block 28 provides the normal force. The normal force provided by a pivot block 28 may facilitate holding an electrical wire 24 to the corresponding electrical contact 22 (i.e., may facilitate maintaining the mechanical and electrical connection between an electrical wire 24 and the corresponding electrical contact 22). For example, the normal force provided by a pivot block 28 may increase the force required to pull an electrical wire 24 out of the electrical connector 14.

To uninstall an electrical wire 24 from the corresponding electrical contact 22, the corresponding pivot block 28 can be moved from the closed position to the open position thereof. Movement of the pivot block 28 from the closed position to the open position may require overcoming the latch force between the associated latch tab 58 and latch opening 60. Movement of the pivot block 28 from the closed position to the open position moves the segment 50 of the electrical conductor 44 of the electrical wire 24 out from between the spring beams 74 of the corresponding electrical contact 22. The electrical wire 24 can then be removed from the receptacle 40 of the pivot block 28 to uninstall the electrical wire 24 from the electrical connector 14.

Figure 7:
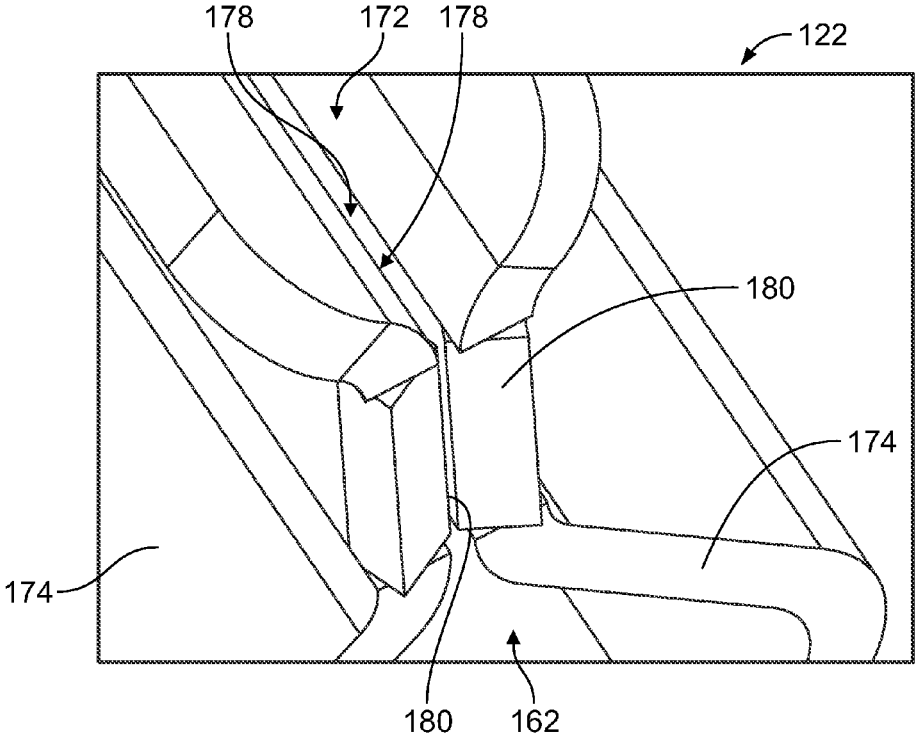
FIG. 7 is a perspective view of a portion of another embodiment of an electrical contact.

FIG. 7 is a perspective view of a portion of another embodiment of an electrical contact 122. The electrical contact 122 includes a base 162 and a wire interface 172 at which the electrical contact 122 is configured to terminate a corresponding electrical wire 24 (FIGS. 1-3, 5, and 6). The wire interface 172 includes opposing spring beams 174 that are configured to pinch the electrical conductor 44 (FIGS. 3 and 6) of the corresponding electrical wire 24 between conductor interfaces 178 of the spring beams 174. In other words, the spring beams 174 are configured to capture the electrical conductor 44 of the corresponding electrical wire 24 between the conductor interfaces 178 with a compliant pinch connection.

One or both of the spring beams 174 includes a burr 180 that is configured to engage in physical contact with the electrical conductor 44 of the corresponding electrical wire 24. The burr 180 may or may not puncture the electrical conductor 44 of the corresponding electrical wire 24. The burr 180 may facilitate holding the corresponding electrical wire 24 to the electrical contact 122 (i.e., may facilitate maintaining the mechanical and electrical connection between the electrical conductor 44 of the corresponding electrical wire 24 and the electrical contact 122), for example via stiction between the burr 180 and the electrical conductor 44, via compression of the electrical conductor 44, and/or via puncturing of the electrical conductor 44. For example, the burr 180 may increase the force required to pull the corresponding electrical wire 24 out of the electrical connector 14.

Figure 8:
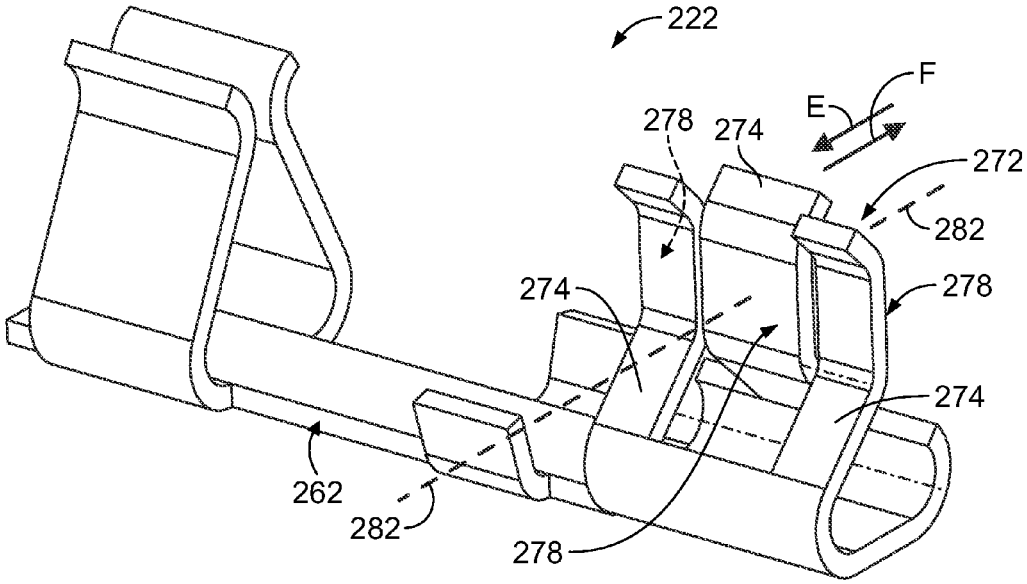
FIG. 8 is a perspective view of another embodiment of an electrical contact.

FIG. 8 is a perspective view of another embodiment of an electrical contact 222. The electrical contact 222 includes a base 262 and a wire interface 272 at which the electrical contact 222 is configured to terminate a corresponding electrical wire 24 (FIGS. 1-3, 5, and 6). The wire interface 272 includes opposing spring beams 274 that are configured to pinch the electrical conductor 44 (FIGS. 3 and 6) of the corresponding electrical wire 24 between conductor interfaces 278 of the spring beams 274. In other words, the spring beams 274 are configured to capture the electrical conductor 44 of the corresponding electrical wire 24 between the conductor interfaces 278 with a compliant pinch connection.

The conductor interfaces 278 of the spring beams 274 overlap each other. Specifically, and as can be seen in FIG. 8, the conductor interfaces 278 overlap each along an axis 282 that extends approximately perpendicular to the length of the corresponding electrical wire 24. The overlapping arrangement of the conductor interfaces 278 may provide higher normal forces in the directions E and F than provided by non-overlapping conductor interfaces (e.g., the conductor interfaces 78 shown in FIGS. 3, 4 and 6). The increased normal forces provided by the overlapping conductor interfaces 278 may facilitate holding an electrical wire 24 to the electrical contact 222 (i.e., may facilitate maintaining the mechanical and electrical connection between an electrical wire 24 and the electrical contact 222). For example, the increased normal force provided by the overlapping conductor interfaces 278 may increase the force required to pull the corresponding electrical wire 24 out of the electrical connector 14.

The embodiments described and/or illustrated herein may provide a pivot block style connector that can accommodate (i.e., terminate with a reliable electrical connection) a larger range of different sizes of electrical wires as compared to at least some known pivot block style connectors.

The embodiments described and/or illustrated herein may provide a pivot block style connector that can accommodate (i.e., terminate with a reliable electrical connection) electrical wires having electrical conductors that include more than seven strands (in addition to accommodating electrical wires having solid electrical conductors and electrical wires having electrical conductors with seven or less strands).

The embodiments described and/or illustrated herein may provide a pivot block style connector that may require less force to terminate electrical wires as compared to at least some known pivot block style connectors.

The embodiments described and/or illustrated herein may provide a pivot block style connector that does not require special tooling to terminate electrical wires.

The embodiments described and/or illustrated herein may provide a pivot block style connector that introduces less operator fatigue as compared to at least some known pivot block style connectors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing;

an electrical contact held by the housing, the electrical contact extends from a wire end to a pin end, the electrical contact comprising opposing spring beams extending along the wire end configured to receive an electrical wire therebetween, the spring beams having conductor interfaces configured to engage in physical contact with the electrical wire such that the electrical wire is captured between the spring beams with a compliant pinch connection, the pin end comprising a contact interface configured to engage in physical contact with a pin of a mating contact to electrically connect the electrical contact to the mating contact; and a pivot block held by the housing, the pivot block comprising a receptacle, the pivot block being pivotable between an open position and a closed position, the receptacle being configured to receive the electrical wire when the pivot block is in the open position, the pivot block being configured to be pivoted from the open position to the closed position to move the electrical wire into engagement in physical contact between the conductor interfaces of the spring beams such that the electrical wire is captured between the spring beams with the compliant pinch connection and thereby electrically connected to the electrical contact, wherein the pin end includes opposing spring beams defining the contact interface comprising a contact interface configured to receive the nm a pin of the mating contact such that the pin is captured between the spring beams of the pin end with a compliant pinch connection to electrically connect the electrical contact to the mating contact.

2. The electrical connector of claim 1, wherein the compliant pinch connection between the electrical wire and the spring beams of the electrical contact is a separable connection.

3. The electrical connector of claim 1, wherein the conductor interface of at least one of the spring beams of the electrical contact is approximately flat.

4. The electrical connector of claim 1, wherein the pivot block exerts a normal force on the electrical wire when the pivot block is in the closed position, the normal force acting in a direction that is approximately perpendicular to the length of the electrical wire.

5. The electrical connector of claim 1, wherein the electrical contact is configured to capture an electrical wire having at least eight strands with the compliant pinch connection.

6. The electrical connector of claim 1, wherein the conductor interfaces of the spring beams of the electrical contact overlap each other.

7. The electrical connector of claim 1, wherein at least one of the spring beams of the electrical contact comprises a burr configured to engage in physical contact with a conductor of the electrical wire to provide a holding force to resist pull-out of the electrical wire from the electrical contact.

8. The electrical connector of claim 1, wherein the electrical connector defines a portion of a thermostat assembly.

9. The electrical connector of claim 1, wherein the electrical contact is configured to be engaged in physical contact with a mating contact of a printed circuit such that the electrical contact is electrically connected to the printed circuit.

10. An electrical connector comprising:

a housing;

an electrical contact held by the housing, the electrical contact extends from a wire end to a pin end, the electrical contact comprising opposing spring beams extending along the wire end configured to receive an electrical wire therebetween, the spring beams having conductor interfaces configured to engage in physical contact with the electrical wire to electrically connect the electrical contact to the electrical wire, wherein the spring beams are resiliently deflectable from natural resting positions thereof such that the spring beams pinch the electrical wire between the conductor interfaces, the pin end comprising a contact interface configured to engage in physical contact with a pin of a mating contact to electrically connect the electrical contact to the mating contact; and a pivot block held by the housing, the pivot block comprising a receptacle, the pivot block being pivotable between an open position and a closed position, the receptacle being configured to receive the electrical wire when the pivot block is in the open position, the pivot block being configured to be pivoted from the open position to the closed position to pinch the electrical wire between the conductor interfaces of the spring beams of the electrical contact, wherein the pin end includes opposing spring beams defining the contact interface comprising a contact interface configured to receive the pin of the mating contact such that the pin is captured between the spring beams of the pin end with a compliant pinch connection to electrically connect the electrical contact to the mating contact.

11. The electrical connector of claim 10, wherein the conductor interface of at least one of the spring beams of the electrical contact is approximately flat.

12. The electrical connector of claim 10, wherein the pivot block exerts a normal force on the electrical wire when the pivot block is in the closed position, the normal force acting in a direction that is approximately perpendicular to the length of the electrical wire.

13. The electrical connector of claim 10, wherein the electrical contact is configured to pinch an electrical wire having at least eight strands between the conductor interfaces of the spring beams such that the electrical contact is electrically connected to the electrical wire.

14. The electrical connector of claim 10, wherein the conductor interfaces of the spring beams of the electrical contact overlap each other.

15. The electrical connector of claim 10, wherein at least one of the spring beams of the electrical contact comprises a burr configured to engage in physical contact with the electrical wire.

16. The electrical connector of claim 10, wherein the electrical connector defines a portion of a thermostat assembly.

17. The electrical connector of claim 10, wherein the electrical contact is configured to be engaged in physical contact with a mating contact of a printed circuit such that the electrical contact is electrically connected to the printed circuit.

* * * * *